US009440248B2

(12) United States Patent
Pouliaude

(10) Patent No.: US 9,440,248 B2
(45) Date of Patent: Sep. 13, 2016

(54) FLUID DISPENSER DEVICE

(71) Applicant: APTAR FRANCE S.A.S., Le Neubourg (FR)

(72) Inventor: Florent Pouliaude, Fouqueville (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 14/198,883

(22) Filed: Mar. 6, 2014

(65) Prior Publication Data

US 2014/0252043 A1 Sep. 11, 2014

Related U.S. Application Data

(60) Provisional application No. 61/807,573, filed on Apr. 2, 2013.

(30) Foreign Application Priority Data

Mar. 6, 2013 (FR) ..... 13 52008

(51) Int. Cl.

| | |
|---|---|
| ***B65D 88/54*** | (2006.01) |
| ***G01F 11/00*** | (2006.01) |
| ***B05B 11/00*** | (2006.01) |
| ***B05B 15/06*** | (2006.01) |
| ***B65D 83/20*** | (2006.01) |

(52) U.S. Cl.

CPC ..... *B05B 11/3045* (2013.01); *B05B 11/0008* (2013.01); *B05B 11/3052* (2013.01); *B05B 15/065* (2013.01); *B65D 83/205* (2013.01)

(58) Field of Classification Search

CPC ..... B05B 11/3045; B05B 11/0008; B05B 11/3052; B05B 15/065; B05B 11/065; B65D 83/205

USPC ..... 222/321.9

See application file for complete search history.

(56) References Cited

U.S. PATENT DOCUMENTS 3,181,895 A * 5/1965 Cator ..... 285/1
8,210,572 B2 * 7/2012 Davis ..... 285/9.1

(Continued)

FOREIGN PATENT DOCUMENTS

DE 20 2010 000 483 U1 10/2010
WO 02/11896 A1 2/2002

OTHER PUBLICATIONS

Search Report of FR 12 52008 dated Oct. 30, 2013.

*Primary Examiner* — Patrick M Buechner
*Assistant Examiner* — Jeremy W Carroll
(74) *Attorney, Agent, or Firm* — Sughrue Mion, PLLC

(57) ABSTRACT

The invention relates to a fluid dispenser device, comprising: a body for mounting in stationary manner on the fluid reservoir; an actuator rod that is moved axially down and up inside the body; and a pusher that is mounted on the actuator rod by connection means including magnetizing means so as to generate a connection, by magnetic attraction, between the actuator rod and the pusher. The connection means comprises a rod organ engaged around the actuator rod and a pusher organ secured to the pusher, the actuator rod defining an internal fluid duct. The pusher forming a connection sleeve defining an internal fluid channel that leads to a dispenser orifice. The rod organ is deformed by the connection sleeve of the pusher, thus joining the duct to the channel in leaktight manner.

20 Claims, 2 Drawing Sheets

(56) References Cited

U.S. PATENT DOCUMENTS 8,342,577 B2 * 1/2013 Schoenoff et al. ..... 285/9.1
2006/0255178 A1 * 11/2006 Juo ..... 239/288
2006/0289679 A1 * 12/2006 Johnson et al. ..... 239/333
2012/0132199 A1 * 5/2012 Kiesewetter ..... 128/200.22
2012/0205401 A1 * 8/2012 Litten et al. ..... 222/252

* cited by examiner

FLUID DISPENSER DEVICE

CROSS REFERENCE TO RELATED APPLICATION

This application claims the benefit under 35 U.S.C. §119 (e) of U.S. provisional patent application Ser. No. 61/807,573, filed Apr. 2, 2013, and priority under 35 U.S.C. §119(a)-(d) of French patent application No. FR-13.52008, filed Mar. 6, 2013.

TECHNICAL FIELD

The present invention relates to a fluid dispenser device, such as a pump or a valve, for associating with a fluid reservoir so as to constitute a fluid dispenser. The dispenser device comprises: a body for mounting in stationary manner on the fluid reservoir; an actuator rod that is moved axially down and up inside the body; and a pusher that is mounted on the actuator rod by connection means. Advantageous fields of application of the present invention are the fields of perfumery, cosmetics, and pharmacy, in which it is common to use fluid dispensers for dispensing various fluids, such as perfumes, lotions, creams, gels, etc.

BACKGROUND OF THE INVENTION

When the pusher incorporates a fluid dispenser orifice, it is frequent for the actuator rod to define an internal fluid duct, and for the pusher to define an internal fluid channel that leads to a dispenser orifice, the connection means butt joining the duct to the channel in leaktight manner. In general, the pusher defines a connection sleeve that forms the inlet of the internal fluid channel. Conventionally, the connection sleeve is force-fitted around the free end of the actuator rod 23, thereby forming a leaktight engagement.

In entirely conventional manner, the body and the actuator rod co-operate with each other to define a pump or valve chamber of volume that is variable. The inlet of the chamber is provided with an inlet valve and the outlet of the chamber is provided with an outlet valve. When the chamber is full of fluid, driving the actuator rod axially into the body causes the volume of the chamber to decrease and the fluid that it contains to be put under pressure. The inlet valve is forced into its closed state and the outlet valve opens under the effect of the pressure. The fluid may thus be discharged through the internal duct of the actuator rod and through the internal channel of the pusher for dispensing at the dispenser orifice. This design is entirely conventional for a pump or a valve in the fields of perfumery, cosmetics, and pharmacy.

In order to establish leaktight engagement between the pusher and the actuator rod, it is necessary to apply sufficient force on the pusher towards the actuator rod. This causes the actuator rod to be driven into the pump body, and causes a dose of fluid to be dispensed when the pump chamber is full of fluid. The operation of engaging the pusher on the actuator rod may thus cause fluid to leak between the actuator rod and the pusher, in particular when leaktight engagement has not yet been formed while fluid is being dispensed. In any event, leaktight engagement on the actuator rod requires the actuator rod to be driven in.

BRIEF SUMMARY OF THE INVENTION

An object of the present invention is to remedy the above-mentioned drawback of the prior art by defining connection means between the pusher and the actuator rod that do not require the actuator rod to be driven into the body while the pusher is being mounted on the actuator rod. Another object of the present invention is to use connection means that do not require any thrust on the actuator rod while the pusher is being mounted on the actuator rod. Still another object of the present invention is to achieve the above-mentioned objects without modifying the operation and the design of a conventional pump or valve.

In the prior art, US 2012/205401 is known for using the magnetization in order to connect a pusher on an actuating rod. Thus, the connection between the pusher and the actuating rod does not occur by pushing, but on the contrary by attraction, which obviates the depression of the actuating rod within the body. However, there is a problem with the tightness of the connection which has to be reached only by the magnetic attraction, and this is not easy. That is why the object of the present invention is to realize the tightness at the magnetic connection.

Thus, the present invention proposes a fluid dispenser device, such as a pump or a valve, for associating with a fluid reservoir so as to constitute a fluid dispenser, the dispenser device comprising: a body for mounting in stationary manner on the fluid reservoir; an actuator rod that is moved axially down and up inside the body; and a pusher that is mounted on the actuator rod by connection means including magnetizing means so as to generate a connection, by magnetic attraction, between the actuator rod and the pusher, the connection means comprising a rod organ engaged around the actuator rod and a pusher organ secured to the pusher, the actuator rod defining an internal fluid duct, and the pusher forming a connection sleeve defining an internal fluid channel that leads to a dispenser orifice, the dispenser device being characterized in that the rod organ is deformed by the connection sleeve of the pusher, thus joining the duct to the channel in leaktight manner. Thus, the deformation of the rod organ by the connection sleeve is used to realize the tightness. Advantageously, the magnetizing means comprise a magnet that is mounted on the pusher, and a ferromagnetic and/or magnetized element that is mounted on the rod organ.

According to an interesting feature of the invention, the rod organ is interposed between the duct and the channel so as to form a fluid product passage section. Advantageously, the rod organ includes a mounting collar that is engaged in leaktight manner on the actuator rod. Preferably, the actuator rod defines an annular upper edge, the mounting collar extending axially above this annular upper edge so as to form a fluid product passage section.

According to a first embodiment, the rod organ comprises a mounting collar supporting a gasket that is compressed by the connection sleeve of the pusher. Advantageously, the connection sleeve forms a projecting sealing bead that deforms the gasket locally. The mounting collar may support a ferromagnetic or magnetized cap. The ferromagnetic or magnetized cap advantageously holds the gasket on the mounting collar.

Thus, in this first embodiment, the mounting collar has only a support function for supporting a ferromagnetic or magnetized part that provides mechanical fastening in combination with the magnet of the pusher, and for supporting a gasket that provides sealing by compression by the connection sleeve of the pusher. The mechanical fastening, sealing, and support functions are clearly separate and distinct.

According to another feature, the rod organ comprises a mounting collar is provided with a flexible layer that comes into leaktight contact with the magnet that is mounted in the pusher. Advantageously, the flexible layer maintains the gasket on the mounting collar. In this way, the mechanical fastening by magnetization also serves to flatten the flexible layer so as to achieve sealing. In a variant, the mounting collar is made from a flexible material filled with ferromagnetic or magnetized particles. In this configuration, the mounting collar performs three functions, namely a support function, a function of mechanical fastening by magnetization, and a function of sealing by flexible deformation. Advantageously, the mounting collar includes a sealing rim that is flattened by the magnet of the pusher. Thus, the connection sleeve forms a first annular leaktight barrier, and the sealing rim that is flattened by the magnet forms a second concentric annular leaktight barrier.

The spirit of the invention resides in using magnetic attraction to form the leaktight connection between a pusher and an actuator rod, while avoiding pressing on the actuator rod or driving it into the body.

BRIEF DESCRIPTION OF THE DRAWINGS

The invention is described more fully below with reference to the accompanying drawings, which show several embodiments of the invention by way of non-limiting example.

In the figures.

DETAILED DESCRIPTION

Figures 1, 2, 3:
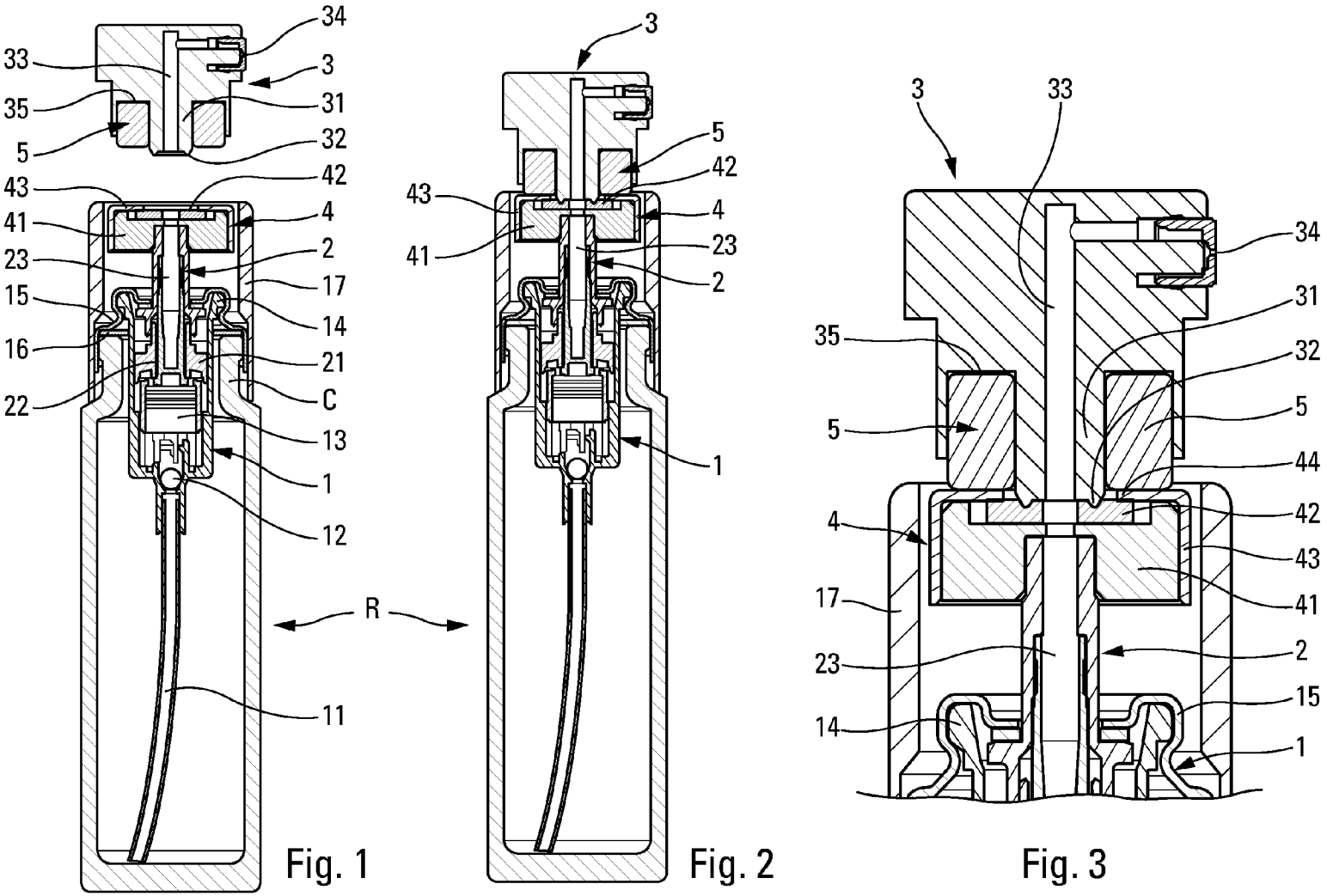
FIG. 1 is a vertical section view through a fluid dispenser in a first embodiment of the invention, with the pusher disconnected from the actuator rod.
FIG. 2 is a view similar to the view in FIG. 1, with the pusher connected to the actuator rod.
FIG. 3 is a greatly enlarged view of the top portion of FIG. 2.

Reference is made firstly to FIGS. 1 to 3 in order to describe in detail the first embodiment of the invention. The fluid dispenser device may be a pump or a valve: in the figures, it is a pump. The dispenser device is associated with a fluid reservoir R that includes a neck C. The reservoir R is not critical to the present invention and, as a result, it may present a wide range of configurations and may be made out of any appropriate material. It suffices that it is suitable for containing a fluid and for presenting an opening at a neck.

The fluid dispenser device of the invention comprises: a body 1 which, in this embodiment, is a pump body; an actuator rod 2; a pusher 3; and connection means 4, 5 for connecting the pusher 3 to the actuator rod 2.

In conventional manner, the pump body 1 includes a dip tube 11 that makes it possible to convey the fluid up to an inlet valve 12 that forms the inlet of a pump chamber 13 that is defined by the actuator rod 2 that includes a piston 21 and forms an outlet valve 22. The pump body 1 also includes a projecting top collar 14 via which the body is held on the neck C of the reservoir R, e.g. by means of a fastener ring 15 that is associated with a neck gasket 16. The fastener ring 15 may be of any kind, e.g. a crimping ring as in the figures, a screw-fastener ring, or a snap-fastener ring. The operation of the pump is entirely conventional: by driving the actuator rod 2 into the body 1 against a return spring, the volume of the chamber 13 decreases and puts the fluid that it contains under pressure. This causes the inlet valve 12 to be pressed into its closed position and the outlet valve 22 to be opened, such that the fluid under pressure can find a passage through the actuator rod 2 that forms an internal duct 23. This design is entirely conventional for a pump in the fields of perfumery, cosmetics, and pharmacy. Optionally, a covering hoop 17 is engaged around the fastener ring 15, the neck C, and the actuator rod 2 for reasons of appearance, or sometimes even functional reasons.

The pusher 3 includes a connection sleeve 31 having a bottom end that advantageously forms a projecting sealing bead 32. The connection sleeve 31 internally defines an internal fluid channel 33 that leads to a dispenser orifice 34, e.g. that may be formed by a nozzle for producing spray. This design is entirely conventional for a pusher that performs a dispensing function.

In the invention, the pusher 3 forms an annular housing 35 around the connection sleeve 31. A magnet 5, that is advantageously a permanent magnet, is received in the housing 35. The magnet 5 may present a shape that is annular or cylindrical, in such a manner as to be engaged around the connection sleeve 35. In a variant, the magnet 5 may be constituted by a plurality of magnet lugs that are distributed inside the housing 35. Instead of the magnet 5, it is also possible to provide a ferromagnetic element, e.g. an element based of iron, nickel, or cobalt. The magnet 5 or the ferromagnetic element constitutes a pusher organ forming part of the magnetizing means of the invention. The magnet 5 or the ferromagnetic element may be inserted directly into the housing 35: in a variant, it may be mounted on a collar that is engaged in the housing 35.

In addition, at its free end, the actuator rod 2 is provided with a rod organ 4 as connection means 4 for co-operating with the magnet 5 of the pusher 3. In this first embodiment of the invention, the connection means 4 include a mounting collar 41 that is mounted by being engaged by force around the free end of the actuator rod 2. By way of example, the mounting collar 41 may be made of plastics material. It serves as a support for a ferromagnetic element that is in the form of a ferromagnetic cap 43 that extends over at least the top of the collar 41, and advantageously over its periphery in such a manner as to form a sheath. The ferromagnetic cap 43 may be held on the mounting collar 41 by being engaged by force. As a result of the ferromagnetic properties, the cap 43 is attracted by the magnet 5 of the pusher 3 that is arranged facing it. The magnet 5 may come into direct contact with the ferromagnetic cap 43, as can be seen in FIGS. 2 and 3. The magnetic attraction ensures that the pusher 3 is held on the actuator rod 2 with sufficient force. In other words, the magnetizing means constituted by the magnet 5 and the ferromagnetic cap 43 make it possible to fasten the pusher 3 mechanically on the actuator rod 2.

The intimate contact between the bottom face of the magnet 5 and the ferromagnetic cap 43 could guarantee sealing at the connection between the internal duct 23 and the internal channel 33. However, in the invention, provision is made to guarantee such sealing by providing an annular gasket 42 that is mounted on the mounting collar 41 and advantageously held in place by the ferromagnetic cap 43. It should be observed that the annular top portion of the ferromagnetic cap 43 extends radially inwards onto the annular gasket 42. The mounting collar 41 may be made with a recess that is suitable for receiving the annular gasket 42 in such a manner that its outer periphery is held by the ferromagnetic cap 43.

Thus, when the pusher 3 is fitted on the connection means 4, the magnet 5 bears against the ferromagnetic cap 43, and simultaneously, the connection sleeve 31 comes into contact with the annular gasket 42. The projecting sealing bead 32 deforms the annular gasket 42 locally so as to guarantee good sealing. In this way, the internal duct 23 is butt joined in completely leaktight manner to the internal duct 33. Furthermore, the magnetic attraction generated by the magnet 5 and the cap 43 guarantees that the pusher 3 is fastened on the actuator rod in satisfactory manner, in particular during dispensing stages.

Figure 4:
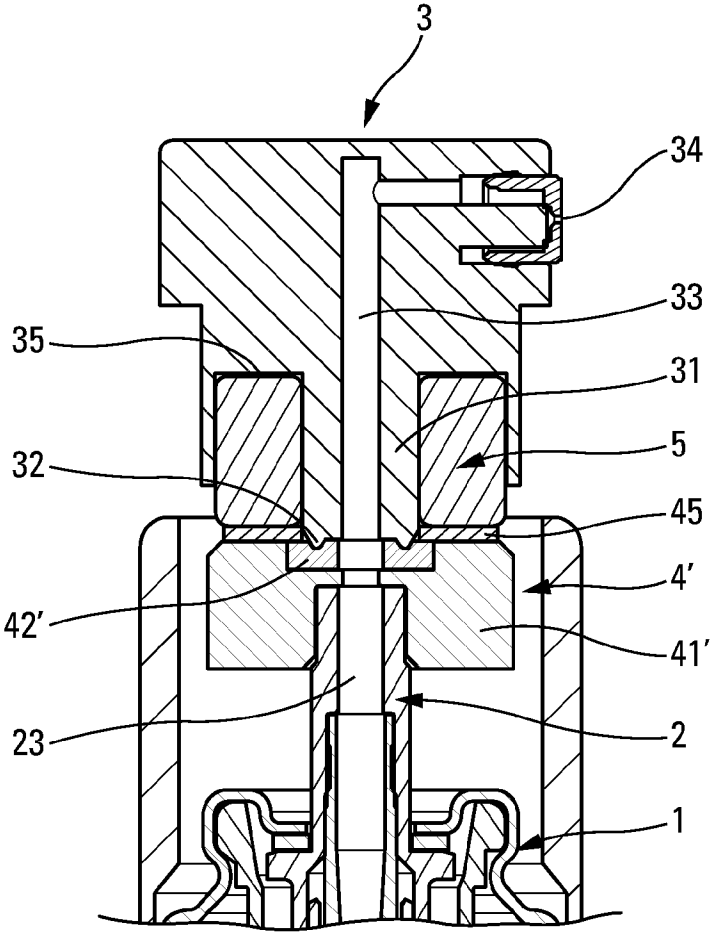
FIG. 4 is a view similar to the view in FIG. 3, showing a second embodiment of the invention.

Reference is made below to FIG. 4 which shows a second embodiment of the invention. The fluid reservoir, the body 1, and the actuator rod 2 may be strictly identical or similar to those of the first embodiment. The pusher 3 may also be identical or similar to that of the first embodiment: in particular it comprises a magnet 5 or a ferromagnetic element that is received directly or indirectly in the reception housing 35 formed around the connection sleeve 31 that preferably forms a projecting sealing bead 32 at its bottom end. In this second embodiment, the connection means include a rod organ 4' forming a mounting collar 41' that is engaged by force around the free end of the actuator rod 2, as in the first embodiment. However, the mounting collar 41' is made of a ferromagnetic or magnetized material. Thus, it performs two functions, namely both a support function and a function of mechanical fastening by magnetic attraction. The collar 41' associated with the magnet 5 thus constitute magnetizing means. The mounting collar 41' also supports an annular gasket 42' for deforming by the connection sleeve 31 so as to form a leaktight butt joint between the internal duct 23 and the internal channel 33. The mounting collar 41' may come into direct contact with the magnet 5. In a variant shown in FIG. 4, the mounting collar 41' is provided with a flexible layer 45 at its top face that is for coming into contact with the magnet 5. In other words, the flexible layer 45 is interposed and flattened between the magnet 5 and the mounting collar 41'. The flexible layer 45 may be of any kind. By way of example, it may be made of an elastomer material. It makes it possible to form soft contact between the magnet 5 and the mounting collar 41'. Furthermore, as a result of it being flattened, it makes it possible to form a second leaktight barrier around the first barrier formed by flattening the annular gasket 42'. The flexible layer 45 may extend inwards onto the annular gasket 42' so as to hold said annular gasket on the mounting collar 41' in substantially similar manner to the first embodiment. The inner edge of the flexible layer 45 may even come into leaktight contact with the connection sleeve 31 so as to provide additional sealing. In a variant, the flexible layer 45 may be secured to the magnet 5 and not to the mounting collar 41'. Although not shown, it is also possible to eliminate the annular gasket 42' and to form direct contact between the connection sleeve 31 and the top end of the actuator rod 2, with sealing being guaranteed entirely by the flexible layer 45.

Figure 5:
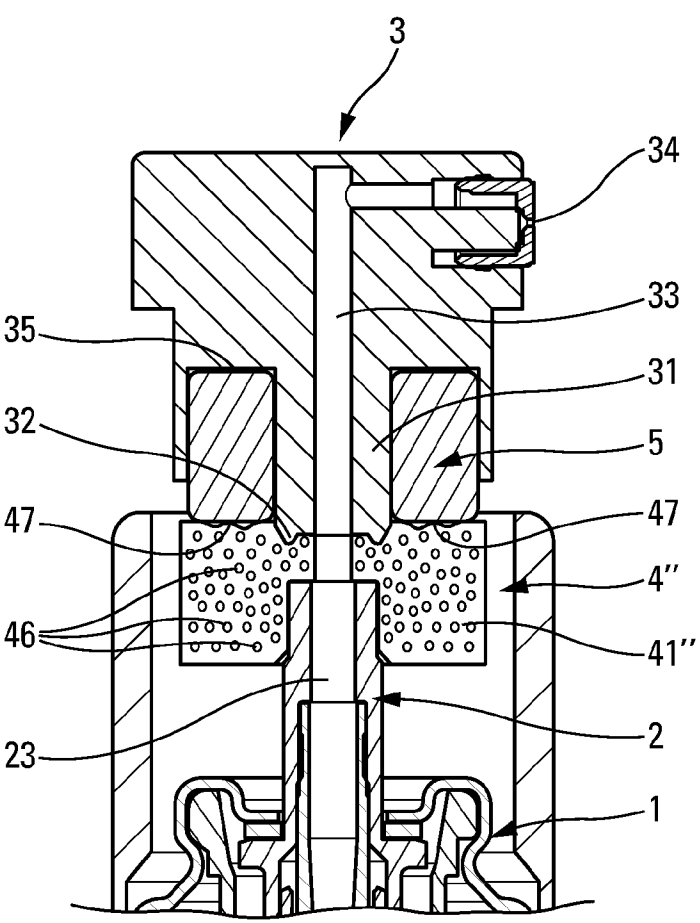
FIG. 5 is a view similar to FIGS. 3 and 4, showing a third embodiment of the invention.

With reference to FIG. 5, a third embodiment of the invention can be seen in which the body 1, the actuator rod 2, and the pusher 3 may be identical or similar to those of the first and second embodiments. Only the connection means 4" differ from the first and second embodiments. In fact, these connection means comprise a rod organ 4" only constituted by a mounting collar 41" that is engaged by force around the free end of the actuator rod 2. The mounting collar 41" is made of a flexible material, such as an elastomer, that is filled with ferromagnetic or magnetic particles 46 that are embedded in the mass of the mounting collar 41". Thus, the mounting collar 41" performs three functions, namely a support function, a function of mechanical fastening by magnetization, and a function of sealing by deformation. The magnet 5 of the pusher 3 may come into direct contact with the mounting collar 41" that is advantageously provided with one or more toroidal rings 47 that project from the top face of the mounting collar 41". The toroidal rings 47 are deformed a little by the magnet 5 in such a manner as to create one or more leaktight annular barriers. In addition, the bottom end of the connection sleeve 31, that optionally is provided with a projecting sealing bead 32, also comes into contact with the mounting collar 41" so as to deform it and thus create a leaktight barrier. Without going beyond the ambit of the invention, it is possible to eliminate the annular rings 47 or the projecting bead 32. Provision can also be made for the connection sleeve 31 to come into direct contact with the top end of the actuator rod 2.

In very general manner, the invention makes it possible to connect the pusher mechanically on the actuator rod by using magnetizing means. The pusher may be a simple pusher without dispenser outlet, such that mechanical fastening is sufficient. When the pusher incorporates a dispenser orifice and an internal channel, mechanical fastening by magnetic attraction must also guarantee sealing at the butt joint between the internal duct 23 of the actuator rod and the internal channel 33 of the pusher. In every embodiment, it is to be noted that the rod organ, and more particularly the mounting collar, is interposed between the duct 23 and the channel 33 so as to form a fluid product passage section. The mounting collar is advantageously engaged in a leaktight manner around the actuator rod 2 and individually or cumulatively performs a support function, a fastening function, a sealing function and/or a fluid product passage function.

The invention claimed is:

1. A fluid dispenser device for associating with a fluid reservoir so as to constitute a fluid dispenser, the dispenser device comprising: a body for mounting in stationary manner on the fluid reservoir; an actuator rod that is moved axially down and up inside the body in an axial direction and that has a distal end extending outside of the body; and a pusher that is mounted on the actuator rod by connection means including magnetizing means so as to generate a connection, by magnetic attraction, between the actuator rod and the pusher, the connection means comprising a rod member engaged around the actuator rod and a pusher member secured to the pusher, the actuator rod defining an internal fluid duct, and the pusher forming a connection sleeve defining an internal fluid channel that leads to a dispenser orifice, wherein the rod member is deformed by the connection sleeve of the pusher, thus joining the duct to the channel in leaktight manner.

2. The dispenser device according to claim 1, wherein the magnetizing means comprise a magnet that is mounted on the pusher, and a ferromagnetic and/or magnetized element that is mounted on the rod member.

3. The dispenser device according to claim 1, wherein the rod member is interposed between the duct and the channel so as to form a fluid product passage section.

4. The dispenser device according to claim 1, wherein the rod member includes a mounting collar that is engaged in leaktight manner on the actuator rod.

5. The dispenser device according to claim 4, wherein the actuator rod defines an annular upper edge, the mounting collar extending axially above this annular upper edge so as to form a fluid product passage section.

6. The dispenser device according to claim 1, wherein the rod member comprises a mounting collar supporting a gasket that is compressed by the connection sleeve of the pusher.

7. The dispenser device according to claim 6, wherein the connection sleeve forms a projecting sealing bead that deforms the gasket locally.

8. The dispenser device according to claim 6, wherein the mounting collar supports a ferromagnetic or magnetized cap.

9. The dispenser device according to claim 8, wherein the ferromagnetic or magnetized cap holds the gasket on the mounting collar.

10. The dispenser device according to claim 1, wherein the rod member comprises a mounting collar provided with a flexible layer that comes into leaktight contact with the magnet that is mounted in the pusher.

11. The dispenser device according to claim 10, wherein the flexible layer maintains the gasket on the mounting collar.

12. The dispenser according to claim 1, wherein the rod member comprises a mounting collar made from a flexible material filled with ferromagnetic or magnetized particles.

13. The dispenser device according to claim 11, wherein the mounting collar includes a sealing rim that is flattened by the magnet of the pusher.

14. The dispenser device according to claim 1, wherein the magnetizing means comprise a magnet formed by the rod member, and a ferromagnetic and/or magnetized element mounted on the pusher.

15. The dispenser device according to claim 1, wherein the dispenser is a pump or a valve.

16. The dispenser device according to claim 1, wherein the rod member is deformed by a distal end of the connection sleeve of the pusher when joining the duct to the channel in leaktight manner.

17. The dispenser device according to claim 1, wherein the deformation is an elastic deformation.

18. The dispenser device according to claim 1, wherein the deformation is in the axial direction.

19. The dispenser device according to claim 1, wherein the deformation results from the magnetic attraction acting in the axial direction.

20. A fluid dispenser device for associating with a fluid reservoir so as to constitute a fluid dispenser, the dispenser device comprising:

a body for mounting in stationary manner on the fluid reservoir;

an actuator rod moveable axially down and up inside the body in an axial direction and that has a distal end extending outside of the body; and a pusher connected to the actuator rod by a magnetic assembly resulting in magnetic attraction between the actuator rod and the pusher, the magnetic assembly comprising a rod member engaged around the actuator rod and a pusher member secured to the pusher;

the actuator rod defines an internal fluid duct, and the pusher forms a connection sleeve defining an internal fluid channel that leads to a dispenser orifice;

the rod member is deformed by a distal end of the connection sleeve of the pusher, the resulting deformation joining the duct to the channel in leaktight manner.

* * * * *